US006434945B1

(12) United States Patent
Mandai et al.

(10) Patent No.: US 6,434,945 B1
(45) Date of Patent: Aug. 20, 2002

(54) DUAL FUEL NOZZLE

(75) Inventors: Shigemi Mandai; Masataka Ohta; Kazuya Kobayashi; Koichi Nishida, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/470,592

(22) Filed: Dec. 22, 1999

(30) Foreign Application Priority Data

Dec. 24, 1998 (JP) ..... 10-367255

(51) Int. Cl.[7] ..... F02C 1/00

(52) U.S. Cl. ..... 60/740; 60/39.463; 60/742; 60/39.3

(58) Field of Search ..... 60/740, 39.463, 60/39.3, 39.55, 737, 742

(56) References Cited

U.S. PATENT DOCUMENTS

| | | | | |
|---|---|---|---|---|
| 3,763,650 A | * | 10/1973 | Hussey et al. | 60/39.74 |
| 4,566,268 A | * | 1/1986 | Hoffeins et al. | 60/39.463 |
| 5,235,814 A | * | 8/1993 | Leonard | 60/738 |
| 5,361,578 A | * | 11/1994 | Donlan | 60/39.32 |
| 5,435,126 A | * | 7/1995 | Beaudoin | 60/39.463 |
| 5,451,160 A | | 9/1995 | Becker | 431/284 |
| 5,729,968 A | | 3/1998 | Cohen et al. | 60/39.06 |

FOREIGN PATENT DOCUMENTS

| | | |
|---|---|---|
| EP | 0 278 699 | 8/1988 |
| WO | WO 90/12987 | 11/1990 |
| WO | WO 99/19670 | 4/1999 |

* cited by examiner

*Primary Examiner*—Charles G. Freay
*Assistant Examiner*—William Rodriguez
(74) *Attorney, Agent, or Firm*—Christie, Parker & Hale, LLP

(57) ABSTRACT

A dual fuel nozzle is provided with two different size injection holes. The first injection holes have larger diameters and are used only for injecting gaseous fuel into a combustion chamber. On the other hand, the second injection nozzles have smaller diameters and are used for injecting either gaseous fuel or liquid fuel as required. When gaseous fuel is used, if the fuel injection amount is large or medium, both of the first and the second injection holes or first injection holes only are used for injecting gaseous fuel depending upon the required fuel injection amount. When the fuel injection amount is low, only the second injection hole is used for injecting gaseous fuel. Therefore, the pressure drop across the fuel nozzle can be kept at sufficiently high level even when the fuel injection amount is low, and thereby combustion vibration is suppressed. Further, when liquid fuel is used, a premixed fuel and steam mixture is injected from the second injection holes. This also keep the pressure drop across the fuel nozzle at high level in order to suppress combustion vibration when the fuel injection amount is low.

4 Claims, 7 Drawing Sheets

VIEW II-II

VIEW IV-IV

DUAL FUEL NOZZLE

BACKGROUND OF THE INVENTION

1. Field of the Invention

The present invention relates to a dual fuel nozzle which is capable of injecting either a gaseous fuel or a liquid fuel into the combustion chamber of, for example, a gas turbine.

2. Description of the Related Art

An engine operating on either a gaseous fuel or a liquid fuel, as required, such as a gas turbine, is equipped with dual fuel nozzles capable of supplying either a gaseous fuel or a liquid fuel to the combustion chamber (combustor) of the engine. Usually, a dual fuel nozzle is provided with separate injection holes exclusively used for a gaseous fuel and a liquid fuel. Further, a dual fuel nozzle is provided with atomizing holes used for injecting atomizing steam or water when liquid fuel is used. Atomizing steam or water is used for atomizing the liquid fuel, and thereby supplying liquid fuel to the combustion chamber in the form of very fine particle in order to suppress exhaust smoke.

FIG. 3 shows a typical longitudinal section of a conventional dual fuel nozzle of a gas turbine and FIG. 4 is an end view of the nozzle viewing from the direction indicated by the line IV—IV in FIG. 3.

In FIG. 3, reference numeral 3 designates a dual fuel nozzle as a whole, 1 designates an inner tube of the combustor of a gas turbine. The dual fuel nozzle 3 is provided with a nozzle tip 6 at the end thereof. A liquid fuel injection hole (a tip hole) 9 for injecting liquid fuel is disposed at the center of the nozzle tip 9 and, as shown in FIGS. 3 and 4, atomizing holes 10 and gaseous fuel injection holes 7 are disposed concentrically around the nozzle tip 6. Further, swirlers 2 for forming a swirl of combustion air are disposed between the nozzle 3 and the inner tube 1.

Combustion air is supplied through an air passage 2*a* formed by an annular space between the nozzle 3 and the inner tube 1. Combustion air in the air passage 2*a* forms a swirl when it passes through the swirler 2 and flows into the combustion chamber (the inside of the inner tube 1).

When gaseous fuel is used, fuel is supplied to a gaseous fuel passages 7*a* and injected into the inner tube 1 from the gaseous fuel injection holes 7. Gaseous fuel injected from the gaseous fuel injection holes 7 burns in the combustion chamber and forms a diffusion flame 8, as shown in FIG. 4. On the other hand, when liquid fuel is used, liquid fuel is supplied to a liquid fuel passage 6*a* and injected from the liquid fuel injection hole 9 of the nozzle tip 6 into the swirl of combustion air and forms the diffusion flame 8. Further, when liquid fuel is used, steam or water is injected from the atomizing holes 10 in order to atomize the liquid fuel injected from the liquid fuel injection hole 9.

However, in the conventional type dual fuel nozzle in FIGS. 3 and 4, especially when the amount of fuel injection is small, vibratory combustion may occur. An engine such as a gas turbine is required to operate over a wide load range. Thus, the amount of fuel injected from the nozzle changes widely in accordance with the change in the engine load. Therefore, in the conventional dual fuel nozzle, the injection holes must have large diameters so that a sufficient amount of fuel can be injected there through when the engine load is high. However, if the injection holes having large diameters are used, it is necessary to reduce the fuel supply pressure largely in order to reduce the fuel injection amount when the engine load is low. When the fuel supply pressure becomes low, the difference between the combustion chamber and the fuel supply pressure (i.e., the pressure difference across the fuel nozzle) becomes small. When the pressure difference across the fuel nozzle is low, the amount of fuel passing through the nozzle, i.e., the fuel injection amount changes largely in response to fluctuation of the pressure in the combustion chamber. Further, the change in the fuel injection amount causes changes in the combustion pressure (the pressure in the combustion chamber). Therefore, the fluctuation of the pressure in the combustion chamber is amplified and vibratory combustion occurs if the frequency of the fluctuation of the pressure in the combustion chamber matches the hydrodynamic natural frequency of the fuel supply system. This causes unstable combustion in the combustion chamber and a low frequency combustion vibration in which vibration and noise due to cyclic change in the pressure in the combustion chamber occur. The combustion vibration occurs when either gaseous fuel or liquid fuel is used if the pressure difference across the fuel nozzle becomes low.

Therefore, in the conventional dual fuel nozzle, it is necessary to keep the fuel injection amount at a relatively large value in order to suppress combustion vibration. This cause a problem when the conventional type dual fuel nozzle is used as a pilot burner for a premixed combustion type low $NO_x$ combustor. The premixed combustion type low $NO_x$ combustor is a combustor which reduces the amount of $NO_x$ generated by combustion by lowering the combustion temperature by burning fuel in a premixed combustion mode in the combustor. However, if the conventional dual fuel nozzle is used for a pilot burner, since the fuel injection amount must be kept at a relatively large value in order to suppress combustion vibration, it is difficult to lower a pilot fuel ratio (a ratio of the fuel injection amount of a pilot burner to a total fuel injection amount of the combustor). In this case, since the fuel injected from the pilot burner burns in a diffusion combustion mode as explained before, a relatively large amount of $NO_x$ is produced by the pilot burner due to a relatively high temperature of the diffusion combustion. Therefore, the amount of $NO_x$ produced by the premixed combustion type combustor increases as the pilot fuel ratio becomes larger. Consequently, if the conventional dual fuel nozzle is used as a pilot burner for the premixed combustion low $NO_x$ combustor, it is difficult to reduce the amount of $NO_x$ sufficiently.

Further, since the conventional dual fuel nozzle requires atomizing holes for injecting steam or water in addition to the gaseous fuel injection holes and liquid fuel injection holes, the construction of the nozzle is complicated.

SUMMARY OF THE INVENTION

In view of the problems in the related art as set forth above, the object of the present invention is to provide a dual fuel nozzle having a simple construction and being capable of suppressing the combustion vibration when the fuel injection amount is low.

The object as set forth above is achieved by a dual fuel nozzle for injecting gaseous fuel and/or liquid fuel into a combustion chamber, according to the present invention. The dual fuel nozzle is provided with a first injection hole and a second injection hole for injecting fuel therefrom, wherein the second injection hole has a diameter smaller than the first injection hole and, when gaseous fuel is used, the nozzle injects gaseous fuel from one of the first and the second injection hole, or both injection holes depending upon the required amount of fuel injection and, when liquid fuel is used, the nozzle injects a mixture of liquid fuel and steam from the second injection hole.

According to the present invention, the dual fuel nozzle is provided with the first injection hole and the second injection hole having a diameter smaller than the first injection hole. When gaseous fuel is used, fuel is injected from the first injection hole or the second injection hole, or both injection holes depending on the amount of fuel injection. For example, when the fuel injection amount is large, gaseous fuel is injected from both of the first and second injection holes. Therefore, a large amount of fuel can be injected into the combustion chamber. When the fuel injection amount is medium, gaseous fuel is injected only from the first injection hole having a larger diameter. When the fuel injection amount is small, gaseous fuel is injected only from the second injection hole having a smaller diameter. Since the second injection hole has a smaller diameter, the flow resistance thereof is high. Therefore, by using the second injection holes, the pressure difference across the nozzle remains large even when the fuel injection amount is small. Consequently, when gaseous fuel is used, the sensitivity of the fuel injection amount to the fluctuation of the pressure in the combustion chamber becomes low, and combustion vibration in the low fuel injection amount operation is effectively suppressed.

Further, when liquid fuel is used, liquid fuel is premixed with steam before it is injected into the combustion chamber. This mixture of fuel and steam is injected from the second injection hole having a smaller diameter. Therefore, the velocity of the mixture passing through the nozzle is kept high even when the fuel injection amount becomes low. This maintains the pressure difference across the nozzle sufficiently high to suppress the combustion vibration when the fuel injection amount is small. Further, since the velocity of the mixture of liquid fuel and steam injected from the second injection hole is high, good atomization of the liquid fuel is obtained without using separate injection of atomizing steam or water. Thus, the dual fuel nozzle of the present invention does not require separate atomizing holes for injecting atomizing steam or water, and thereby the construction of the nozzle becomes largely simplified.

The dual fuel nozzle according to the present invention may be used as a pilot burner or a main burner of a gas turbine combustor. If the dual fuel nozzle according to the present invention is used as a pilot burner for a premixed combustion type low $NO_x$ gas turbine combustor, the pilot fuel ratio can be largely reduced and, thereby, the total amount of $NO_x$ produced by the combustor can be sufficiently reduced.

BRIEF DESCRIPTION OF THE DRAWINGS

The present invention will be better understood from the description, as set forth hereinafter, with reference to the accompanying drawings in which.

DESCRIPTION OF THE PREFERRED EMBODIMENT

Hereinafter, embodiments of the dual fuel nozzle according to the present invention will be explained with reference to FIGS. 1 through 9.

Figure 1:
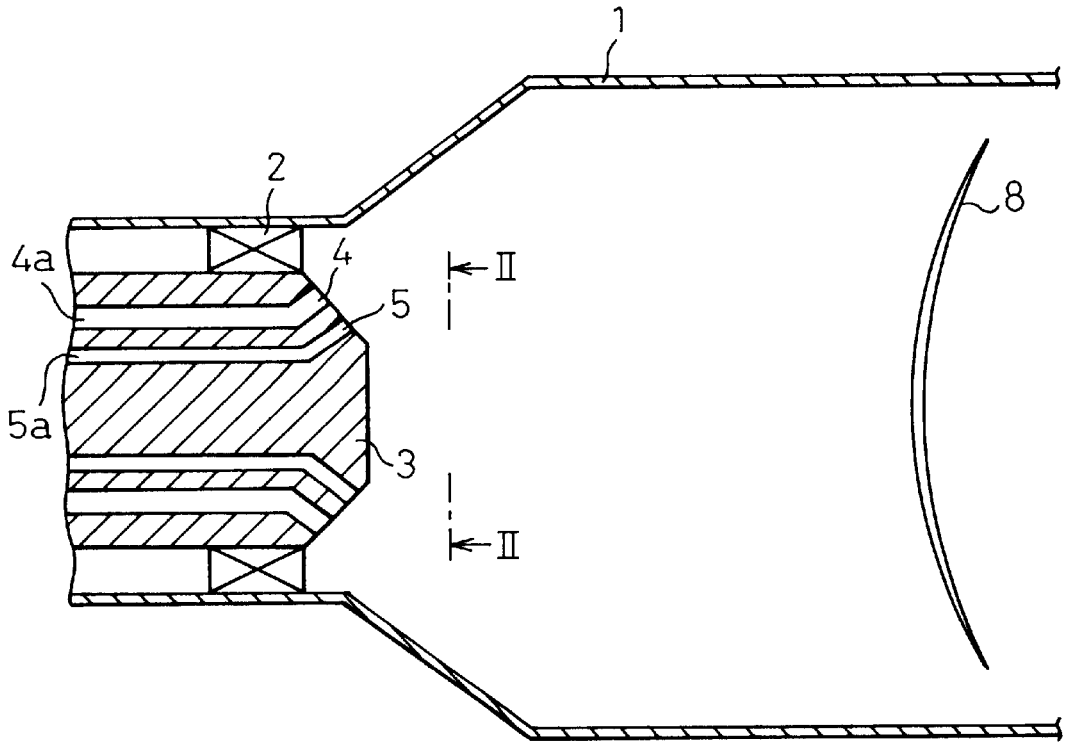
FIG. 1 shows a schematic longitudinal section view of an embodiment of a dual fuel nozzle according to the present invention.

FIG. 1 is a sectional view of an embodiment of a dual fuel nozzle according to the present invention. In FIG. 1, reference numeral the same as those in FIGS. 3 and 4 designate similar elements.

Figure 2:
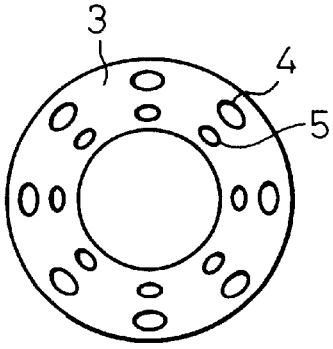
FIG. 2 shows an end view of the nozzle viewing from the direction II—II in FIG. 1.
Figure 3:
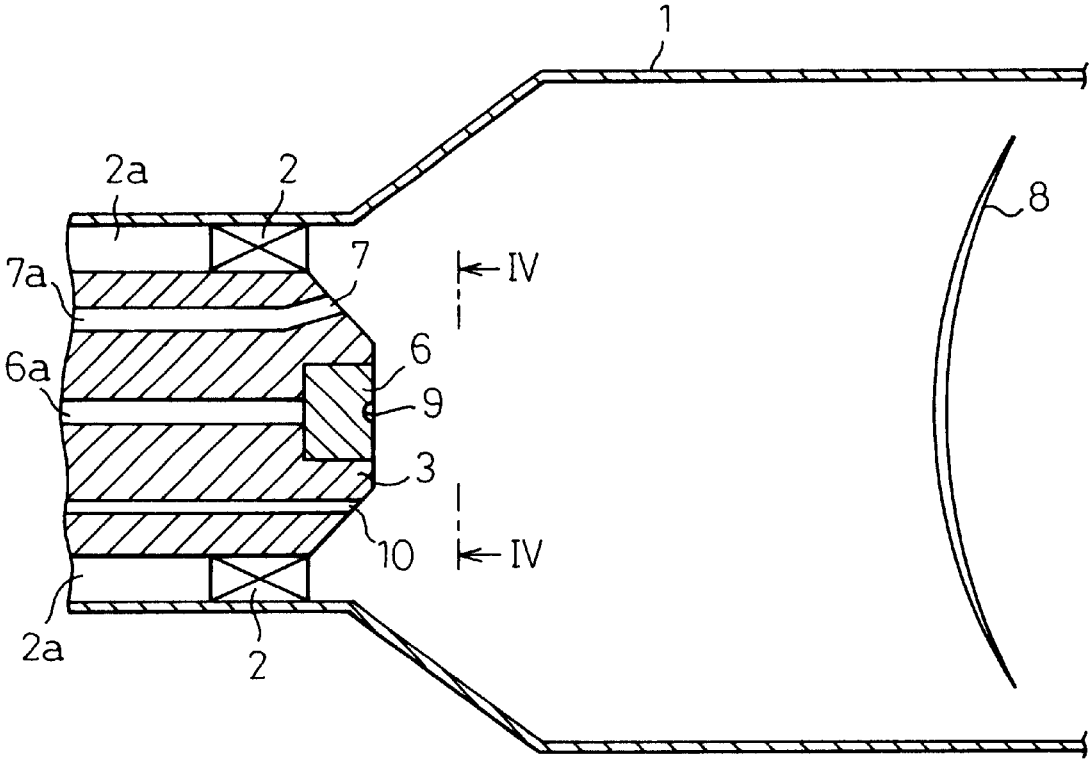
Fig. 3 RELATED ART
FIG. 3 shows a schematic longitudinal section view of a conventional dual fuel nozzle.
Figure 4:
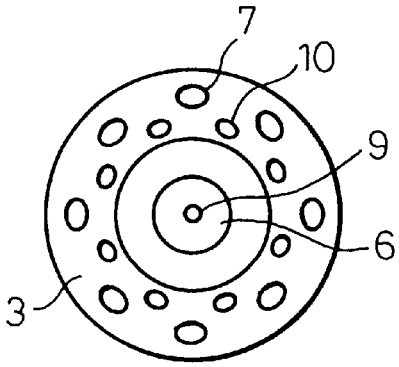
Fig. 4 RELATED ART
FIG. 4 shows an end view of the conventional dual fuel nozzle viewing from the direction IV—IV in FIG. 3.

In this embodiment, a dual fuel nozzle 3 is provided with a plurality of first injection holes 4 having a relatively large diameter and second injection holes 5 having a diameter smaller than that of the first injection holes. Numeral 4*a* and 5*a* in FIG. 1 are first fuel passages connected to the first injection holes and second fuel passages connected to the second injection holes, respectively. FIG. 2 is an end view of the dual fuel nozzle in FIG. 1 viewing from the direction II—II in FIG. 1. As shown in FIG. 2, the first injection holes 4 and the second injection holes 5 are arranged in concentric manner on the end of the nozzle 3.

The first fuel passages 4*a* and the first injection holes 4 in this embodiment are used exclusively for gaseous fuel and the second fuel passages 5*a* and the second injection holes 5 having smaller diameters are used for either gaseous and liquid fuel depending upon requirement.

Namely, when gaseous fuel is used, both of the first and the second injection holes 4 and 5 are used for injecting fuel if a large amount of fuel is to be injected. On the other hand, if the required fuel injection amount is small, only the second injection holes 5 having smaller diameters are used for injecting gaseous fuel. Further, when a medium amount of fuel is to be injected, only the first injection holes having larger diameters are used. By switching the injection holes in accordance with the required fuel injection amount, a total cross sectional area of the flow passage of fuel is set at an appropriate value in accordance with the fuel injection amount. For example, when the fuel injection amount is large, the total cross sectional area of the fuel flow passage is set at a large value by using both of the first and the second injection holes 4 and 5. In this case, flow resistance through the fuel passage does not become excessively high when a large amount of fuel flows therethrough. Therefore, a sufficient amount of fuel can be supplied to the combustor. Further, when the fuel injection amount is small, the total cross sectional area of the fuel flow passage is set at a small value by using only the second injection holes 5. Therefore, the pressure difference across the nozzle is not lowered even when the fuel injection amount is low. In this case, the fuel flow amount through the nozzle (i.e., fuel injection amount) does not change largely even when the pressure in the combustion chamber fluctuates. Thus, combustion vibration in the low fuel injection amount operation is effectively suppressed.

When liquid fuel is injected, liquid fuel is premixed with steam and the mixture of fuel and steam is supplied through the second fuel flow passages 5*a* and the second injection holes 5 having smaller diameters. Therefore, in this embodiment, the velocity of the mixture flowing through the passage 5*a* and the injection holes 5 becomes much higher than that in the case where only liquid fuel is injected from the second injection holes 5. Thus, when liquid fuel is used, the pressure difference across the nozzle is always kept at a sufficiently high value in order to suppress combustion vibration in a low fuel injection amount operation.

Further, when liquid fuel is used, since liquid fuel is premixed with steam before it is supplied to the nozzle 3, the dual fuel nozzle in this embodiment does not require separate atomizing holes (numeral 10 in FIGS. 3 and 4) for injecting atomizing steam or water. Therefore, the construction of the dual fuel nozzle 3 is largely simplified according to the present embodiment.

The actual diameters of fuel passages 4*a*, 5*a* and injection holes 4, 5 as well as the flow range for using the respective injection holes and fuel passages are determined, preferably by experiment, in such a manner that a pressure difference across the nozzle becomes sufficiently high for suppressing the combustion vibration over the entire range of fuel injection amounts.

Figure 5:
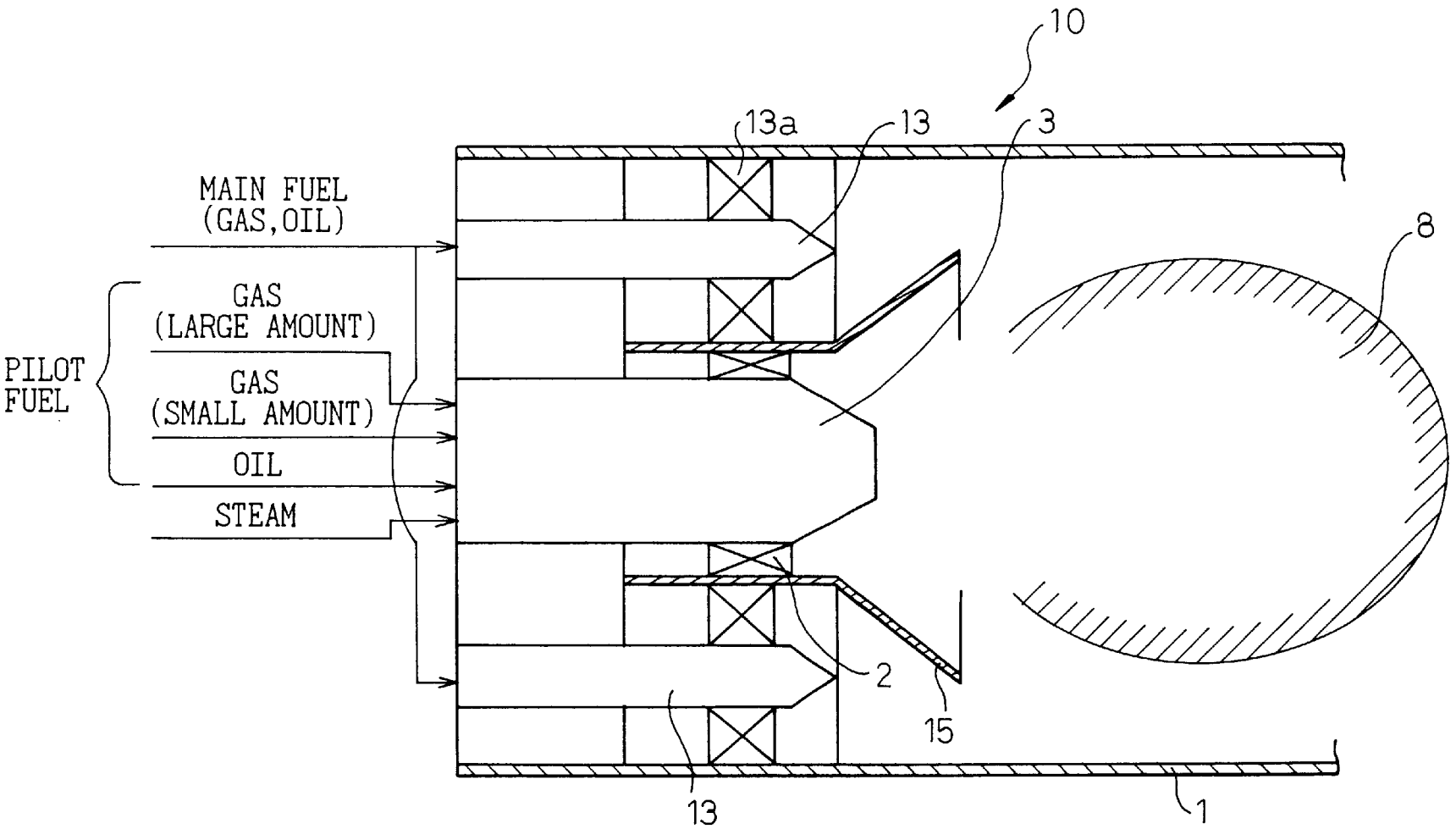
FIG. 5 is a partial longitudinal section view of a premixed combustion type combustor of a gas turbine which uses the dual fuel nozzle in FIG. 1 as a pilot burner.
Figure 6:
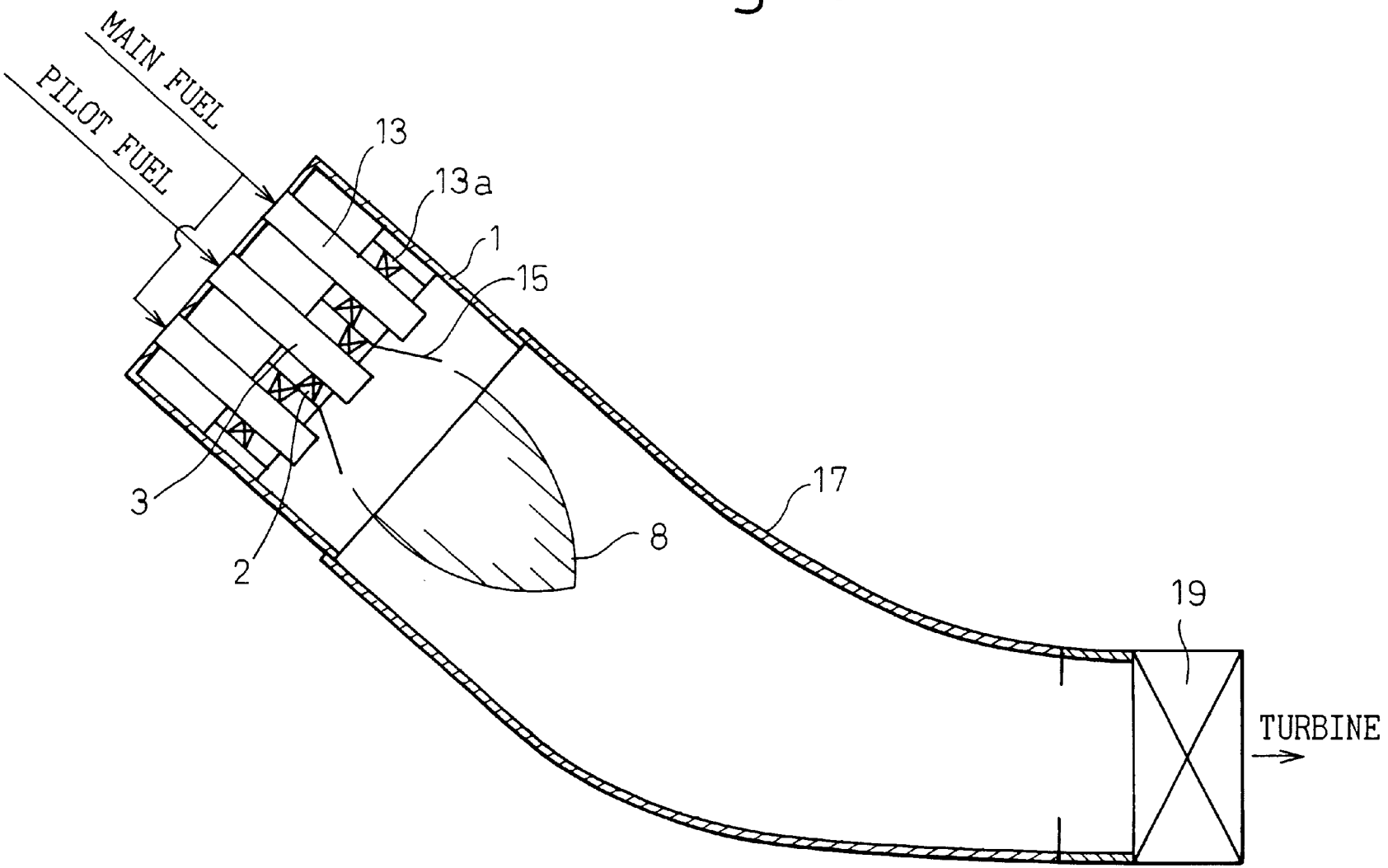
FIG. 6 is a longitudinal section view showing the construction of the combustor in FIG. 5.
Figure 7:
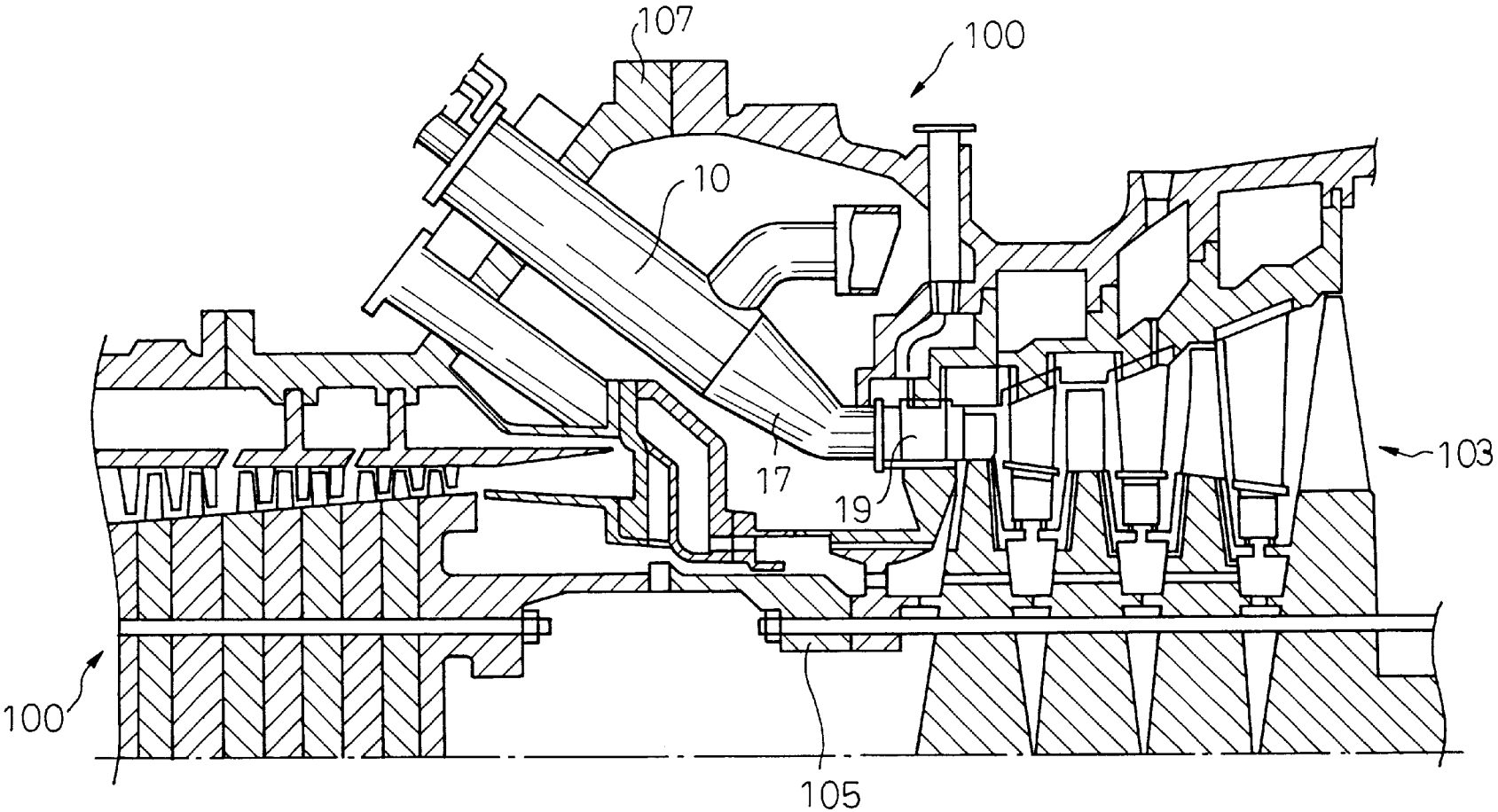
FIG. 7 is a partial section view showing the arrangement of the combustor in a gas turbine.

FIGS. 5 to 7 show an embodiment in which the present invention is applied to a premixed combustion type gas turbine combustor. FIGS. 5 and 6 are longitudinal section view of the gas turbine combustor. In FIGS. 5 to 7, reference numerals the same as those in FIG. 1 designate similar elements.

In FIG. 5, the dual fuel nozzle 3 according to the present invention is disposed along the center axis of a cylindrical combustor 10 and acts as a pilot burner. In the combustor 10, a plurality of main nozzles 13 are disposed around the dual fuel nozzle 3 and a conical shape cone 15 surrounding the nozzle 3 is disposed between the dual fuel nozzle 3 and the main nozzles 13. Fuel injected from the respective main nozzles 13 mixes with combustion air passing through swirlers 13*a* of the main nozzles and forms a mixture of fuel and air. This premixed fuel and air is ignited by the flame 8 produced by the pilot burner 3 in the inner tube 1.

FIG. 7 is a sectional view of a gas turbine which shows the arrangement of the combustor within the gas turbine. In FIG. 7, numeral 100 designates a gas turbine as a whole, 101 designates an axial compressor of the gas turbine and 103 designates turbines installed on a rotor shaft 105 connected to the compressor 101. Ambient air is pressurized by the compressor 101 and flows into the casing 107 of the gas turbine. The pressurized air in the casing 107 is, then, supplied to the combustor 10 as combustion air from the combustion air inlet port (not shown) disposed near one end of the combustor 10. As shown in FIGS. 6 and 7, the inner tube 1 of the combustor 10 is connected to a tail tube 17, and the combustion gas produced in the inner tube 1 is supplied to first stage stators 19 of turbines through the tail tube 17. The combustion gas passes through the stators 19 turns the turbine rotor 105 and, via the rotor shaft 105, the compressor 101 and external load connected to the rotor shaft 105.

Figure 8:
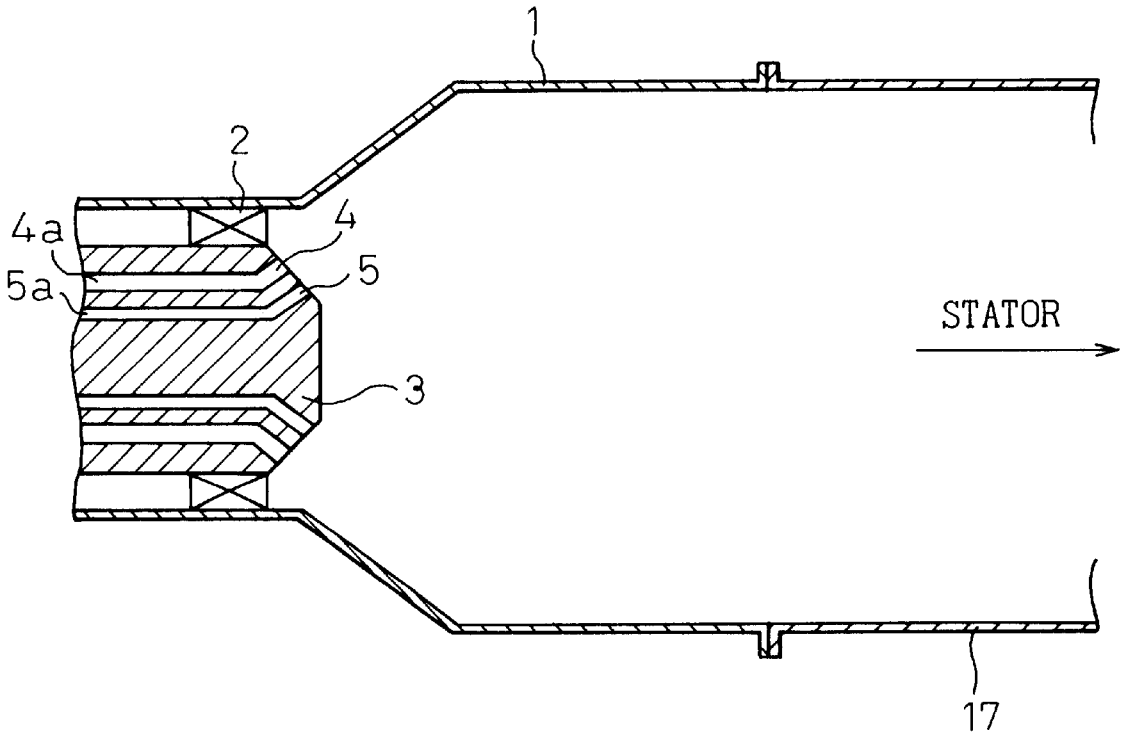
FIG. 8 is a partial longitudinal section view of a diffusion combustion type combustor of a gas turbine which uses the dual fuel nozzle in FIG. 1 as a main burner.

FIG. 8 shows another embodiment in which the present invention is applied to a diffusion combustion type combustor of a gas turbine. In FIG. 8, reference numerals the same as those in FIG. 1 designate similar elements. In FIG. 8, the dual fuel nozzle 3 of the present invention acts as a main nozzle of the combustor 10 and the diffusion combustion occurs in the combustor 10. The inner tube 1 of the combustor 10 is connected to the tail tube 17 and the combustion gas produced by the main burner 3 is directed to the stators (not shown) through the tail tube 17.

Figure 9:
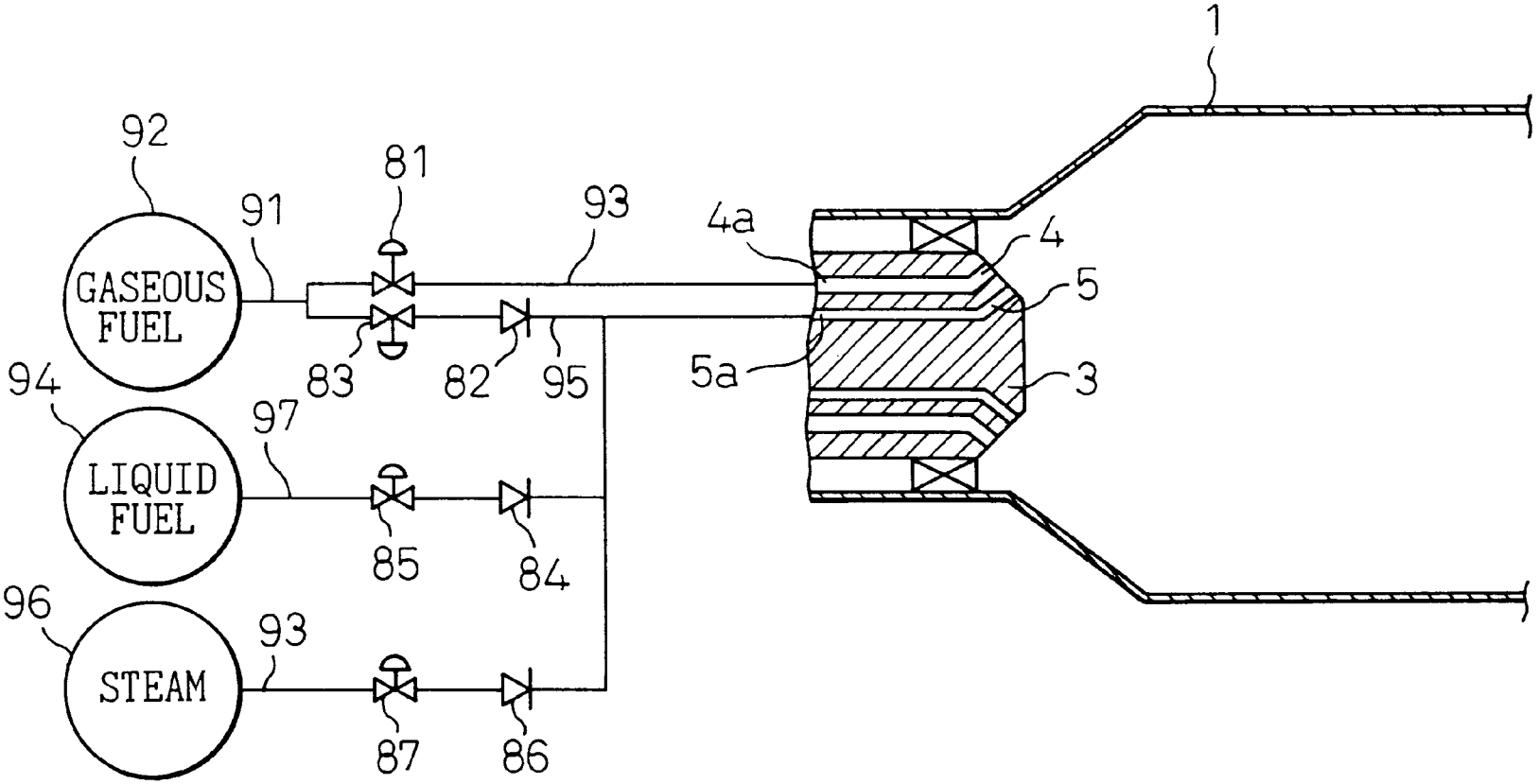
FIG. 9 is a schematic drawing explaining a changeover between gaseous fuel and liquid fuel of a dual fuel nozzle.

FIG. 9 schematically shows the fuel supply system for supplying fuel to the dual fuel nozzle 3. In FIG. 9, numeral 91 designates a gaseous fuel line connected to a pressurized gaseous fuel source 92. 93 and 95 are branch lines which connect the gaseous fuel line 91 to the fuel passages 4*a* and 5*a*, respectively. On the lines 93 and 95, flow control valves 81 and 83 are disposed. Further, on the branch line 95, a check valve 82 is disposed in order to prevent the liquid fuel from entering into the gaseous fuel line 91 when liquid fuel is supplied to the second fuel passage 5*a*.

The branch line 95 is further connected to a pressurized liquid fuel source 94 via a liquid fuel line 97 and to a steam source 96 via a steam line 99. On the lines 97 and 99, flow control valves 85, 87 and check valves 84 and 86, respectively, are disposed. The check valves 84 and 86 prevents gaseous fuel from entering into the liquid fuel line 97 and the steam line 99 when gaseous fuel is supplied to the second fuel passage 5*a*.

In the arrangement in FIG. 9, fuel can be switched from gaseous fuel to liquid fuel, or vice versa, without extinguishing the flame in the combustor 10. During the switching of fuel, both gaseous fuel and liquid fuel are supplied to dual fuel nozzle 3 at the same time by adjusting the flow control valves 83 and/or 85 and flow control valves 87 and 89 in accordance with the operating condition of the gas turbine.

What is claimed is:

1. A method for operating a dual fuel nozzle to inject gaseous fuel and/or liquid fuel into a combustion chamber, the fuel nozzle being provided with a first injection hole and a second injection hole for injecting fuel therefrom, the second injection hole having a diameter smaller than the first injection hole, whereby, when gaseous fuel is used, the nozzle injects gaseous fuel from one of the first and the second injection holes alone, or from both injection holes simultaneously, to provide for three different levels of gaseous fuel Injection depending upon the required amount of fuel injection and, when liquid fuel is used, the nozzle injects a mixture of liquid fuel and steam from the second injection hole.

2. The method as set forth in claim 1, wherein the method comprises operating the nozzle as a pilot burner of a gas turbine combustor.

3. The method as set forth in claim 1, wherein the method comprises operating the nozzle as a main burner of a gas turbine combustor.

4. The method as set forth in claim 2, wherein the method comprises operating the gas turbine combustor as a premixed combustion type combustor.

* * * * *